US005868254A

United States Patent [19]

Price et al.

[11] Patent Number: 5,868,254

[45] Date of Patent: Feb. 9, 1999

[54] SHIPPING ASSEMBLY AND METHOD OF USE

[75] Inventors: Lorie L. Price, Eagan; Paul E. Raber, St. Paul, both of Minn.

[73] Assignee: Minnesota Mining and Manfacturing Company, St. Paul, Minn.

[21] Appl. No.: 929,576

[22] Filed: Sep. 15, 1997

[51] Int. Cl.[6] ..... B65D 5/52

[52] U.S. Cl. ..... 206/736; 206/736; 206/806; 206/45.2

[58] Field of Search ..... 206/736, 746, 206/45.2, 45.21, 806, 526

[56] References Cited

U.S. PATENT DOCUMENTS

| | | | |
|---|---|---|---|
| 1,732,436 | 10/1929 | Floto | 206/45.21 |
| 1,955,252 | 4/1934 | Palla . | |
| 2,030,996 | 2/1936 | Lustig . | |
| 2,072,695 | 3/1937 | Wellman . | |
| 4,312,449 | 1/1982 | Kinderman . | |
| 4,378,903 | 4/1983 | Sherwood | 206/806 |
| 5,405,022 | 4/1995 | Rissley | 206/806 |
| 5,458,231 | 10/1995 | Belokin et al. . | |
| 5,730,296 | 3/1998 | Limmer | 206/580 |

FOREIGN PATENT DOCUMENTS 0 144 899 6/1985 European Pat. Off. .

OTHER PUBLICATIONS

P. 25 from a book entitled "Fibre Box Handbook" bearing a 1992 copyright and available from Fibre Box Association, 2850 Golf Road, Rolling Meadows, IL 60008.

*Primary Examiner*—Paul T. Sewell
*Assistant Examiner*—Jila Mohandesi
*Attorney, Agent, or Firm*—William L. Huebsch

[57] ABSTRACT

A method for handling product enclosures each containing a product and having a through opening. A five panel fiberboard folder is provided that includes first, second, third, fourth and fifth elongate panels each having opposite longitudinally extending sides, one longitudinally extending side of the fourth panel being joined to one longitudinally extending side of the third panel, and the longitudinally extending side of the fourth panel opposite the third panel being joined to one longitudinally extending side of the fifth panel. The fifth panel has a plurality of through cuts between its major surfaces each defining a hook portion of the fifth panel projecting toward a first end of the fifth panel, and the five panel folder has perforations affording separation of the fourth panel from between the third and fifth panels. The product enclosures containing the products are engaged with the hook portions of the fifth panel by inserting the hook portions through the openings in the product enclosures so that the product enclosures are supported along one major surface of the fifth panel. The folder is folded between the sides of the panels so that the first, second, third, and fourth elongate side panels form a longitudinally extending cavity having a rectangular cross section and the major surface of the fifth panel opposite the product enclosures is positioned along one major surface of the first panel within the cavity. The folded folder containing the product enclosures is moved to a different location. The fourth panel is separated from between the third and fifth panels, and the fifth panel and the product enclosures thereon are removed from within the cavity. The fifth panel can have a through aperture adjacent its first end from which it can be hung to display the products in the product enclosures.

14 Claims, 4 Drawing Sheets

SHIPPING ASSEMBLY AND METHOD OF USE

FIELD OF THE INVENTION

The present invention relates to shipping assemblies by which product enclosures (e.g., cards having products secured to them or bags containing products) having through openings by which the product enclosures can be hung from projections received in the openings are moved between different locations such as from a manufacture's packaging facility to a store at which the products in the product enclosures are displayed for sale.

BACKGROUND OF THE INVENTION

Many different products to be sold (e.g., rolls or strips of adhesive coated tape, hooks, etc.) are either secured to pasteboard cards of various sizes by a polymeric layer extending over the product and affixed to the to card around the product or placed in bags typically of polymeric material. Such product enclosures typically have a through opening (e.g., an opening having a generally triangular shape known in the industry as a "delta hole") which will receive a projection on which the product enclosures can be hung at the location at which the products are sold. Such product enclosures can be hung at that location on a strip of polymeric material that has hook like portions spaced along its length and projecting toward a first end of the strip from which the strip is hung. Those hook-like portions are inserted through the openings in a multiplicity of the product enclosures so that portions of those product enclosures are engaged between the hook-like portions and a portion of the strip from which those portions project. Product enclosures containing products are typically attached to the polymeric strips at the manufactures packaging facilities and are sent on the strips to the place at which the products in the product enclosures are displayed. Each polymeric strip and the product enclosure attached to it are typically sent to that place in a five panel corrugated fiberboard folder of the type illustrated at page 25 in a book entitled "Fibre Box Handbook" bearing a 1992 copyright and available from Fibre Box Association, 2850 Golf Road, Rolling Meadows, Ill. 60008, the content whereof is incorporated herein by reference. The polymeric strip with the product enclosures attached thereto are positioned on the fiberboard folder, the fiberboard folder is folded, and adhesive coated tape and/or staples are then applied to the folder to make it into a finished box around the polymeric strip and the product enclosures, which box is then shipped or otherwise moved from the manufacturer to the place at which the product enclosures are to be displayed for sale. When that box is received, it is opened, the polymeric strip with the product enclosures supported thereon is removed from the folder and hung from a support received in an apertures at the first ends of the strip.

SUMMARY OF THE INVENTION

The present invention provides an improved method for handling such product enclosures with products in them, which improved handling method facilitates moving such product enclosures from a packaging facility to the place at which the products in the product enclosures are displayed for sale.

The method according to the present invention for handling product enclosures each containing a product and having a through opening comprises the steps of:

(1) providing a five panel fiberboard folder including first, second, third, fourth and fifth elongate panels each having opposite longitudinally extending sides and opposite major surfaces extending between those sides, one longitudinally extending side of the fourth panel being joined to one longitudinally extending side of the third panel, and the longitudinally extending side of the fourth panel opposite the third panel being joined to one longitudinally extending side of the fifth panel, the fifth panel having a plurality of through cuts between its major surfaces each defining a hook portion of the fifth panel projecting toward a first end of the fifth panel, and the five panel folder having means along the opposite longitudinal sides of the fourth panel for affording separation of the fourth panel from between the third and fifth panels, (2) engaging the product enclosures containing the products with the hook portions of the fifth panel by inserting the hook portions through the openings in the product enclosures so that the product enclosures are supported along one major surface of the fifth panel, and (3) folding the folder between the sides of the panels so that the first, second, third, and fourth elongate side panels form a longitudinally extending cavity having a rectangular cross section and the major surface of the fifth panel opposite the product enclosures is positioned along one major surface of the first panel within the cavity, (4) moving the folded folder containing the product enclosures to a different location, (5) separating the fourth panel from between the third and fifth panels, and (6) removing the fifth panel and the product enclosures thereon from within the cavity.

The fifth panel can have a through aperture adjacent its first end, and the method can comprise the further step, after the removing step, of hanging the fifth panel from a hook received in the through aperture to display the products in the product enclosures.

BRIEF DESCRIPTION OF DRAWING

The present invention will be further described with reference to the accompanying drawing wherein like reference numerals refer to like parts in the several views, and wherein.

DETAILED DESCRIPTION

Figure 2:
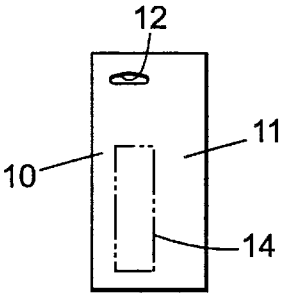
FIG. 2 is an enlarged plan view of a product enclosure in the form of a card to which a product is attached.

Referring now to FIGS. 1 through 7 of the drawing there is illustrated an improved method according to the present invention for handling product enclosures 10 such as cards 11 having through openings 12 and products 14 secured to them (see FIG. 2). That improved handling method facilitates moving such product enclosures 10 such as from a manufactures packaging facility to a place such as a store at which the products 14 in the product enclosures 10 are displayed for sale.

Figure 1:
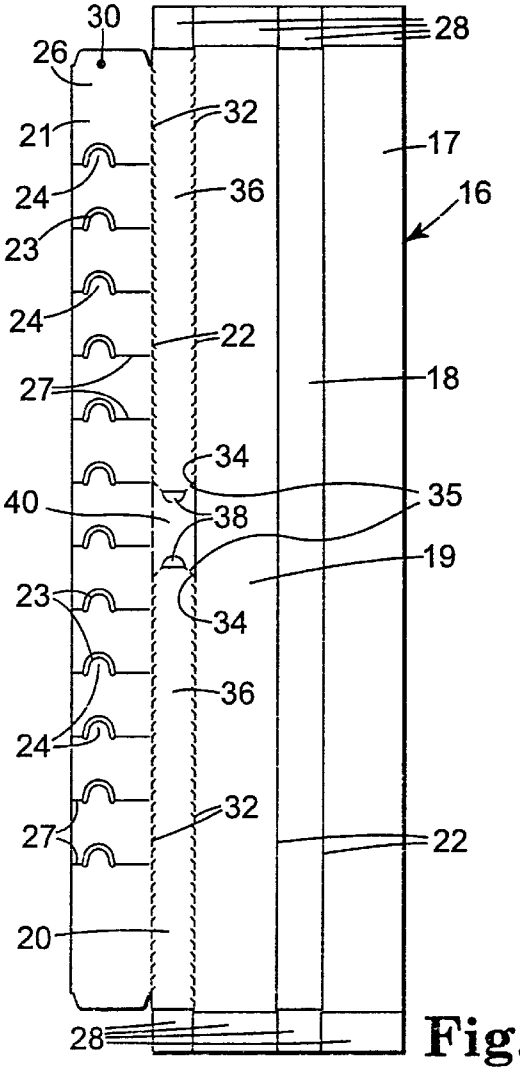
FIG. 1 is a plan view of a first embodiment of a five panel folder according to the present invention.

That improved method includes the step of providing a five panel fiberboard folder 16 illustrated in FIG. 1. That fiberboard folder 16 includes first, second, third, fourth and fifth elongate panels, 17, 18, 19, 20, and 21 respectively, each of which panels has opposite longitudinally extending sides 22 defined by a crease between the panels 17, 18, 19, 20, and 21, and opposite major surfaces extending between those sides 22. One longitudinally extending side 22 of the first panel 17 is joined to one longitudinally extending side 22 of the second panel 18, the other longitudinally extending side 22 of the second panel 18 is joined to one longitudinally extending side of the third panel 19, the other longitudinally extending side 22 of the third panel 19 is joined to one longitudinally extending side of the fourth panel 20. The longitudinally extending side 22 of the fourth panel 20 opposite the third panel 19 is joined to one longitudinally extending side of the fifth panel 21. The fifth panel 21 has a plurality of through cuts forming arch-like openings 23 between its major surfaces and each defining a hook portion 24 of the fifth panel projecting toward a first end 26 of the fifth panel 21. Also, the five panel folder 16 has means along the opposite longitudinal sides 22 of the fourth panel 20 for affording manual separation of the fourth panel 20 from between the third and fifth panels 19 and 21. The folder 16 also includes an end tab 28 at each end of each panel 17, 18, 19, 20, and 21 that is used in closing the folder 16 as will later be described.

Figure 3:
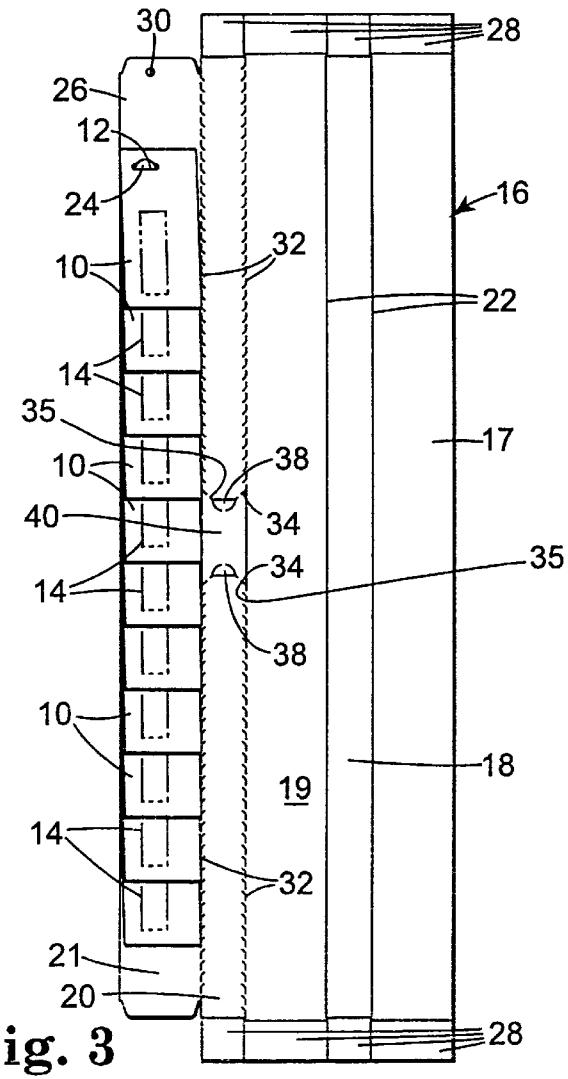
FIG. 3 is a plan view of the five panel folder of FIG. 1 having supported thereon a plurality of the product enclosures of FIG. 2.

The handling method includes engaging the product enclosures 10 with the products 14 in them with the hook portions 24 of the fifth panel 21 by inserting the hook portions 24 of the fifth panel 21 through the openings 12 in the cards 11 so that the product enclosures 10 are supported along one major surface of the fifth panel 21 (see FIG. 3). The fifth panel 21 has creases 27 between the hook portions 24 and the rest of the fifth panel 21 which facilitates bending the hook portions 24 slightly out of the plane of the rest of the fifth panel 21 to engage the hook portions 24 through the openings 12 in the cards 11. The openings 12 in the cards 11 have a generally triangular shape known in the industry as a "delta hole". The product enclosures 10 are typically manually engaged with the hook portions 24 at a product packaging facility starting from the end of the fifth panel 21 opposite its first end 26. Because the hook portions 24 are spaced at a distance that is less than the length of the cards 10, such engagement results in the product enclosures 10 being disposed with their ends opposite their openings 12 projecting away from the first end 26 of the fifth panel 21 and overlaying the next product enclosure 10 in the manner of shingles along the length of the fifth panel 21.

Figure 4:
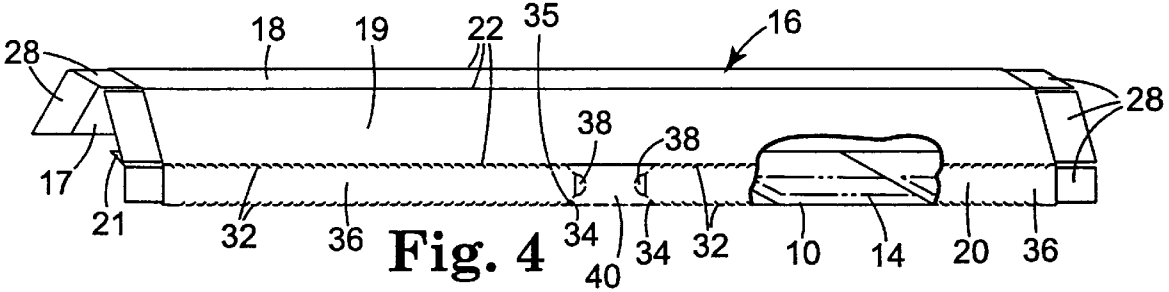
FIGS. 4 and 5 are perspective views of the five panel folder of FIG. 3 sequentially illustrating closing of the folder around the product enclosures supported thereon.
Figure 5:
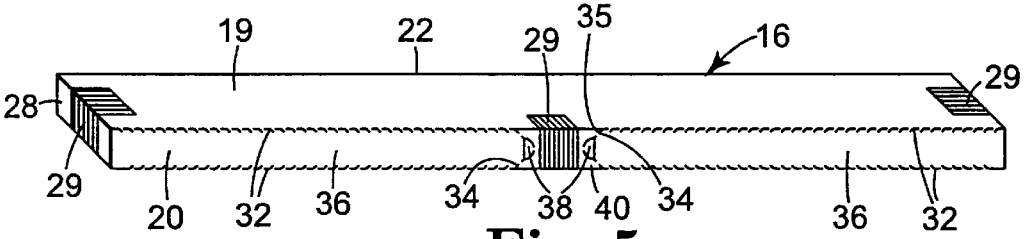

After the hook portions 24 are engaged with the product enclosures 10, the folder 16 is folded along the sides 22 of the panels 17, 18, 19, and 20 as is sequentially illustrated in FIGS. 4 and 5 so that first, second, third, and fourth elongate side panels 17, 18, 19, and 20 form a longitudinally extending cavity having a rectangular cross section, and the major surface of the fifth panel 21 opposite the product enclosures 10 with the products contained therein is positioned along one major surface of the first panel 17 within the cavity. The folder 16 is then bent to position the end tabs 28 across the opposite ends of the cavity, and staples or lengths of tape 29 as illustrated in FIG. 5 are applied to maintain the folder 16 in its closed position with the product enclosures 10 within the cavity.

The folded folder 16 containing the product enclosures 10 is then moved by commercial shipment, or otherwise, to a different location, such as to the location of a merchant at which the products 12 are to be displayed for sale.

Figure 6:
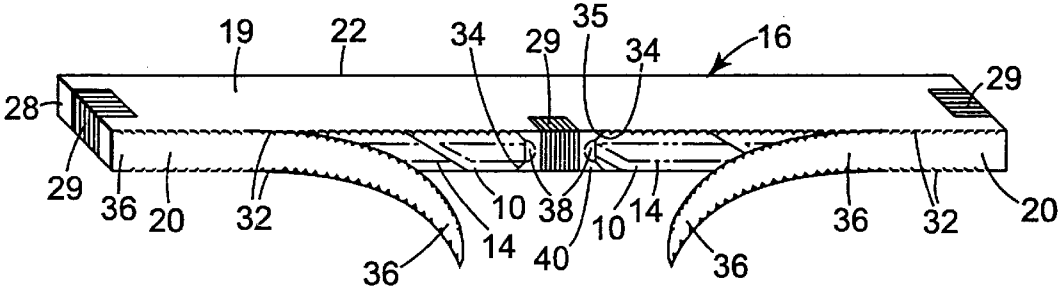
FIG. 6 is a perspective view illustrating tearing away of a fourth panel of the five panel folder to open the closed folder of FIG. 5.

At that different location, the fourth panel 20 is manually separated from between the third and fifth panels 19 and 21 as is illustrated in FIG. 6, whereupon the fifth panel 21 and the product enclosures containing the products 12 are removed from within the cavity.

Figure 7:
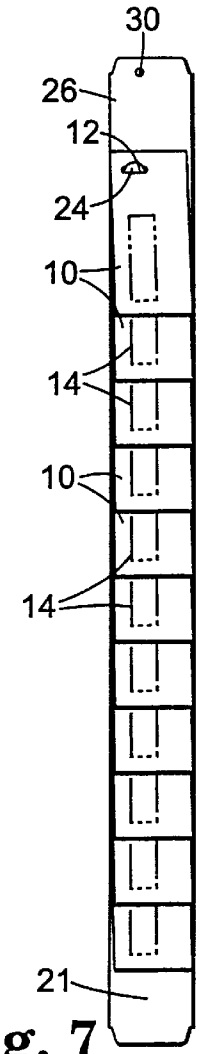
FIG. 7 is vertical view of a fifth panel of the five panel folder having the product enclosures supported thereon after the fifth panel is separated from the rest of the five panel folder by opening the closed folder as was illustrated in FIG. 3.

The fifth panel 21 has a through aperture 30 adjacent its first end 26, and the fifth panel 21 can be hung from a hook received in the through aperture 30 to display the products 12 in the product enclosures 10 in the orientation illustrated in FIG. 7.

The means along the opposite longitudinal sides 22 of the fourth panel 20 for affording manual separation of the fourth panel 20 from between the third and fifth panels 19 and 21 comprises rows of perforations 32 through the fiberboard folder 16 along the sides 22 of the fourth panel 20, and cuts 34 through the fourth panel 20 between the opposite longitudinal sides 22 of the fourth panel. The cuts 34 are disposed generally centrally along the fourth panel 20 and define adjacent tapered ends of two opposite end portions 36 of the fourth panel 20. Those adjacent tapered ends are adapted to be manually engaged by the fourth panel having cuts partially defining generally "D" shaped removable parts 38 of the fourth panel 20 at their ends. Those removable parts 38 allow a person to insert his or her fingers through openings formed by punching out the circular removable parts 38 to manually engage the tapered ends, and to then sequential removal of the opposite end portions 36 of the fourth panel 20 starting from those tapered ends. A central part 40 of the fourth panel 20 between those opposed tapered ends 35 has perforations along its side joining the fifth panel 21 so that it can separated from the fifth panel 21 after the tape 29 at that location is cut or removed and the opposite end portions 36 of the fourth panel 20 are manually separated form the third and fifth panels 19 and 21.

As an example, the folder 16 can be made of 200 pound "B" flute corrugated fiberboard. The first, second, third, and fourth panels 17, 18, 19, and 20 can all have lengths of about 47.4 inches (120.4 centimeters) and widths of about 3.9 inches (9.9 centimeters), 2.1 inches (5.33 centimeters), 4 inches (10.2 centimeters), and 2 inches (5.1 centimeters) respectively. The end tabs 28 can extend 1.9 inches (4.8 centimeters) past the ends of the panels 17, 18, 19, and 20. The fifth panel 21 can have a length of about 47.2 inches (119.9 centimeters), and a width of about 2.9 inches (7.4 centimeters). Their can be twelve arch-like openings 23 defining twelve hook portions 24 which are spaced by about 3.1 inches (7.9 centimeters) and start about 7.1 inches (18 centimeters) from the end of the fifth panel 21 opposite its first end 26. The hook portions 24 can have widths at their bases of about 1.4 inches (3.6 centimeters) and can have radiuses at their tips of about 0.44 inch (1.1 centimeters). The width of the opening 23 at the tips of the hook portions 24 can be about 0.45 inch (1.1 centimeters), and the side of the opening 23 opposite the hook portions can be defined by a radius of about 0.75 inch (1.9 centimeter).

The folder 16 can be made as illustrated or as the mirror image thereof, and the version of the folder 16 can be used that is most advantageous for hanging the product enclosures 10. For example, the folder 16 as illustrated can be useful for hanging a product enclosure 10 that is wider than the fifth panel 21 and has its weight centered below its opening 12 that is located on the right side of the front surface of the product enclosure 12; whereas, the mirror image of the folder 16 as illustrated can be useful for hanging a product enclosure 10 that is wider than the fifth panel 21 and has its weight centered below its opening 12 that is located on the left side of the front surface of the product enclosure 12.

Figure 8:
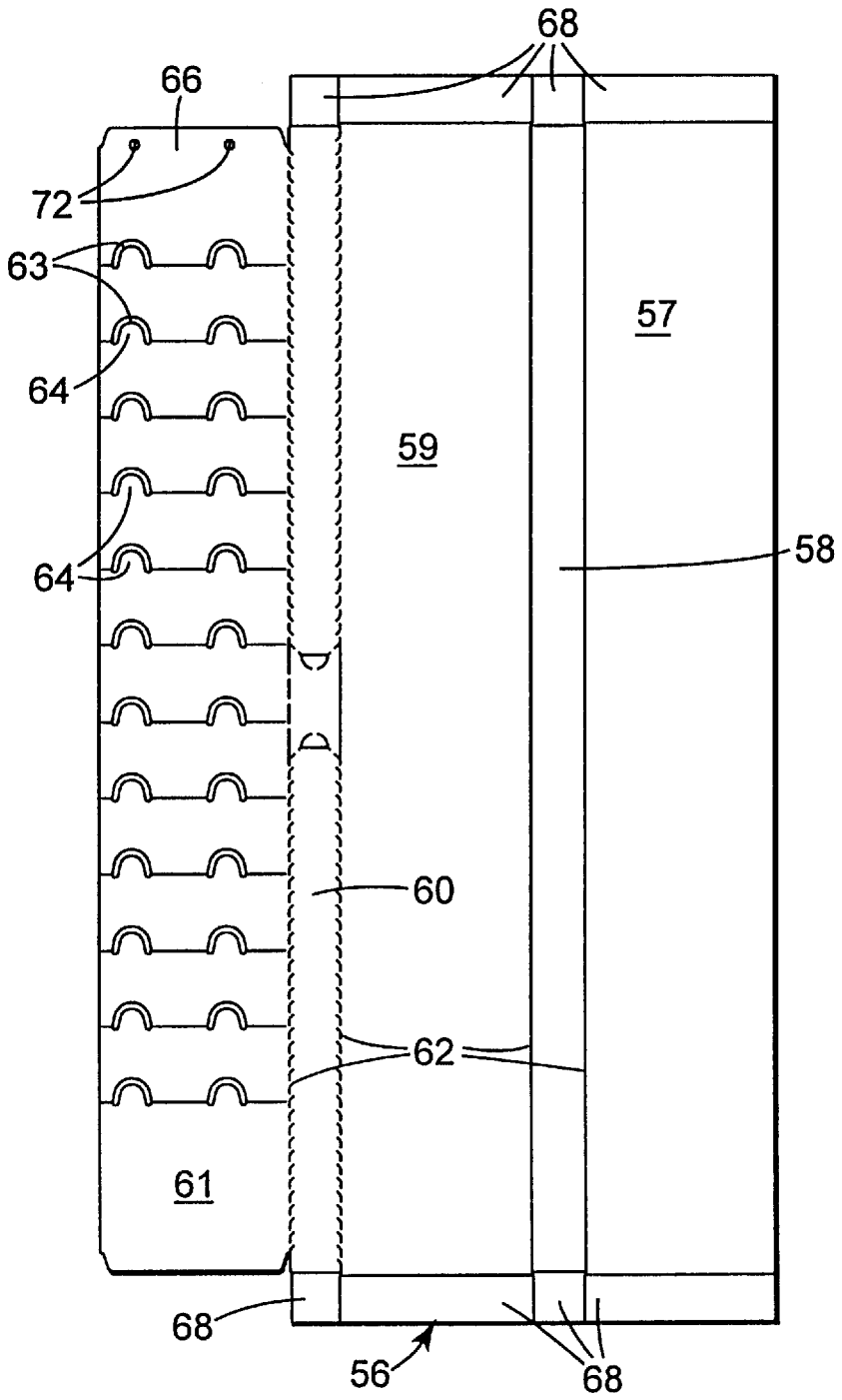
FIG. 8 is a plan view of a second embodiment of a five panel folder according to the present invention.

Referring now to FIG. 8 of the drawing there is illustrated a second embodiment of a five panel fiberboard folder 56 that can be used in the method described above. Like the fiberboard folder 16, the fiberboard folder 56 includes first, second, third, fourth and fifth elongate panels, 57, 58, 59, 60, and 61 respectively, each of which panels has opposite longitudinally extending sides 62 defined by a crease between the panels 57, 58, 59, 60, and 61, and opposite major surfaces extending between those sides 62. One longitudinally extending side 62 of the first panel 57 is joined to one longitudinally extending side 62 of the second panel 58, the other longitudinally extending side 62 of the second panel 58 is joined to one longitudinally extending side of the third panel 59, the other longitudinally extending side 62 of the third panel 59 is joined to one longitudinally extending side of the fourth panel 60. The longitudinally extending side 62 of the fourth panel 60 opposite the third panel 59 is joined to one longitudinally extending side of the fifth panel 61. The fifth panel 61 has a plurality of through arch-like openings 63 between its major surfaces each defining a hook portion 64 of the fifth panel projecting toward a first end 66 of the fifth panel 61. Also, the five panel folder 56 has means along the opposite longitudinal sides 62 of the fourth panel 60 like those described above for the folder 16 for affording manual separation of the fourth panel 60 from between the third and fifth panels 59 and 61. The folder 56 also includes an end tab 68 at each end of each panel 57, 58, 59, 60, and 61 that is used in closing the folder 56 as was described above for the folder 16. The five panel folder 56 differs from the folder 16 described above in that the fifth panel 61 has two rows of hook portions 64 and, if desired, could be divided by one row or two rows of perforations (not illustrated) to form two portions of the fifth panel 61 that can be manually separated and each hung on a projection inserted through an aperture 72 at its first end, Thus the fifth panel 61 can support two rows of product enclosures 10 when the folder 56 is closed and used to transport the cards, and could be used to either support two rows of product enclosures 10 where the products 14 are sold, or could be separated into two portions each supporting one row of product enclosures 10 containing products 14.

Five panel folders with more than two rows of hook portions could also be provided.

Figure 9:
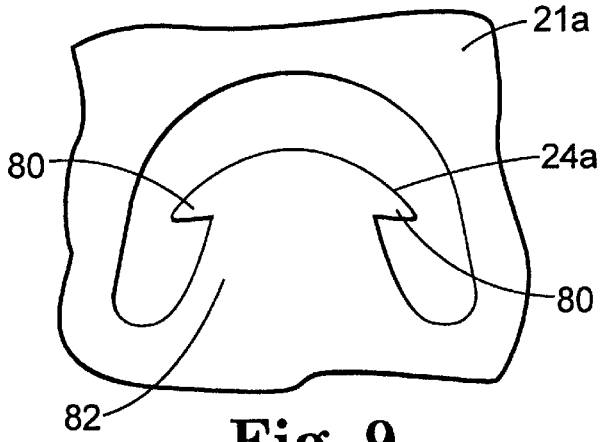
FIGS. 9, 10, and 11 are fragmentary view of alternative shapes for hook portions of the fifth panel of the five panel folder on which the product enclosures are supported.
Figure 10:
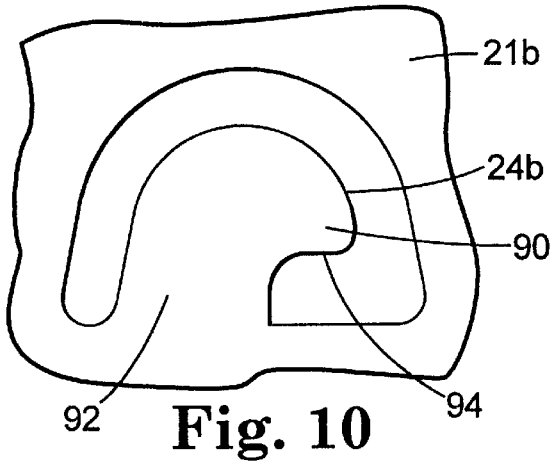
Figure 11:
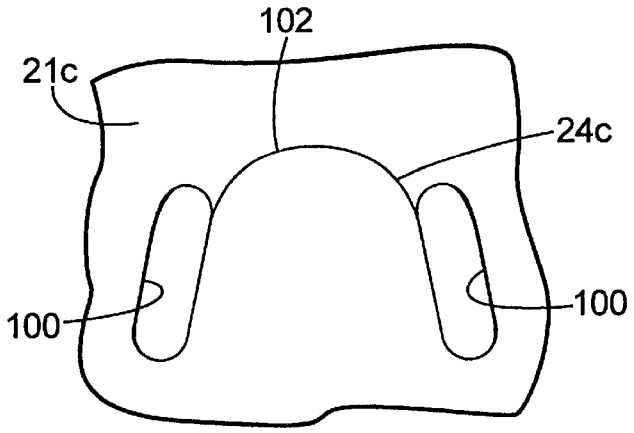

FIGS. 9, 10 and 11 illustrate alternative shapes that could be provided for the hook portions 24 on the fifth panel 21 to securely attach the product enclosures 10 thereto.

The hook portion 24*a* of FIG. 9 has the shape of a blunted arrowhead with barbs 80 projecting from opposite sides of its distal end portion that have a width slightly greater that the width of the opening 12 in the product enclosures 10, and has a proximal base portion 82 that is no greater in width than that opening 12. The fifth panel 21*a* has an opening around the entire hook portion 24*a*. The barbs 80 are deflected as they pass through the opening 12 in a product enclosure 10 and restrict movement of the product enclosure 10 back over the barbs 80.

The hook portion 24*b* of FIG. 10 has the shape of an inverted "J" with a side projection 90 at its distal end portion that has a width greater that the width of the opening 12 in the product enclosures 10 when measured at a right angle to the longitudinal sides of the fifth panel 21*b*, and has a proximal base portion 92 that is no greater in width than that opening 12. The fifth panel 21*b* has an opening around the entire hook portion 24*b*. The product enclosure 10 is engaged with the distal end portion of the hook portion 24*b* with the product enclosure disposed at about a right angle to the orientation desired, and is rotated around the side portion 90 into the desired orientation around the base porion 92 at which an edge surface 94 on the side projection 90 prevents the product enclosure 10 from moving off of the hook portion 24*b* in a direction at right angles to that edge surface 94, which is the only way the product enclosures 10 can move within the closed folder 16 because of the width of the cavity in the product enclosure 10.

The hook portion 24*c* of FIG. 11 has the shape of an inverted "U" with openings 100 adjacent the sides of its proximal portion, and a distal end portion separated from the rest of the fifth panel 21*c* by only a cut 102 through the panel 21*c* material. The hook portion 24*c* has a width that is no greater than that of the opening 12 in the product enclosure 10. The hook portion 24*c* is inserted through the opening 12 in the product enclosure 10. Portions of the product enclosure 10 between the opening 12 and the adjacent edge of the product enclosure 10 at the opposite sides of the opening 12 pass through the openings 100 at the sides of the hook portion 24*c* and are slightly bent so that the distal end portion of the Hook portion 24*c* can again move to a position closely adjacent the portion of the fifth panel 21*c* from which it was cut, thereby securing the portions of the product enclosure 10 in the openings 100 and restricting movement of the product enclosure 10 off of the hook portion 24*c*.

The present invention has now been described with reference to one version of a method, and two embodiments of a five panel folder that can be used in that method, and several possible modifications thereof It will be apparent to those skilled in the art that many changes can be made in the method and embodiments described without departing from the scope of the present invention. Thus, the scope of the present invention should not be limited to the structures and methods described in this application, but only by the structures and method described by the language of the claims and the equivalents thereof.

We claim:

1. A shipping assembly comprising:

a five panel fiberboard folder including first, second, third, fourth and fifth elongate panels each having opposite longitudinally extending sides and opposite major surfaces extending between said sides, one longitudinally extending side of said fourth panel being joined to one longitudinally extending side of said third panel, and the longitudinally extending side of said fourth panel opposite said third panel being joined to one longitudinally extending side of said fifth panel, said folder being folded along said sides so that said first, second, third, and fourth elongate side panels form a longitudinally extending cavity having a rectangular cross section, and one major surface of said fifth panel being positioned along one major surface of said first panel within said cavity, said fifth panel having a plurality of through cuts between said major surfaces each defining a hook portion of said fifth panel projecting toward a first end of said fifth panel, said shipping assembly further including a plurality of product enclosures each having a product therein and a through opening receiving one of said hook portions of said fifth panel to support said product enclosure and the product therein on said fifth panel, and said five panel folder having means along the opposite longitudinal sides of said fourth panel for affording manual separation of said fourth panel from between said third and fifth panels to separate said fifth panel from said fourth panel and to afford access to said fifth panel and said product enclosures supported thereon within said cavity.

2. A shipping assembly according to claim 1 wherein said fifth panel has a through aperture adjacent said first end adapted, after said fifth panel is separated from said fourth panel, for receiving a hook to hang said fifth panel and thereby display said products within said product enclosures.

3. A shipping assembly according to claim 1 wherein said means along the opposite longitudinal sides of said fourth panel for affording manual separation of said fourth panel from between said third and fifth panels comprises rows of perforations through said fiberboard folder along the sides of said fourth panel.

4. A shipping assembly according to claim 1 wherein said fifth panel has openings around said hook portions and said hook portions each have generally the shape of a blunted arrowhead with opposite sides, barbs projecting from said opposite sides of a distal portion of said hook portion that have a width slightly greater that the width of the openings in the product enclosures, and has a base at the proximal portion of said hook portion that is no greater in width than the opening in said product enclosures so that said barbs are deflected as they pass through the opening in the product enclosure, and restrict movement of the product enclosure back over the barbs.

5. A shipping assembly according to claim 1 wherein said fifth panel has opening around said hook portions and said hook portions each have generally the shape of an inverted "J" with a side projection at its distal end that has a width greater that the width of the opening in the product enclosures when measured at a right angle to the longitudinal sides of said fifth panel, and has a proximal base portion that is no greater in width than the opening in the product enclosure, the product enclosure being engaged with the distal end portion of the hook portion with the product enclosure disposed at about a right angle to the orientation desired, and rotated around said side projection into the desired orientation, said hook portion having an edge surface on said side projection then preventing the product enclosure from moving off of the hook portion in a direction at right angles to said edge surface.

6. A shipping assembly according to claim 1 wherein said fifth panel has an opening on each side of each of said hook portions and said hook portions each have generally the shape of an inverted "U" and a distal end portion separated from the rest of the fifth panel by only said cut through said fifth panel, said hook portion having a width that is no greater than that of the opening in the product enclosure, said hook portion being inserted through the opening in the product enclosure with portions of the product enclosure between the opening and an adjacent edge of the product enclosure at the opposite sides of the opening in the product enclosure passing through the openings at the sides of the hook portion and being slightly bent so that the distal end portion of the hook portion is positioned adjacent the portion of the fifth panel from which it was cut, thereby securing the portions of the product enclosure in the openings and restricting movement of the product enclosure off of the hook portion.

7. A five panel fiberboard folder including first, second, third, fourth and fifth elongate panels each having opposite longitudinally extending sides and opposite major surfaces extending between said sides, one longitudinally extending side of said fourth panel being joined to one longitudinally extending side of said third panel, and the longitudinally extending side of said fourth panel opposite said third panel being joined to one longitudinally extending side of said fifth panel, said folder being foldable along said longitudinally extending sides so that said first, second, third, and fourth elongate side panels form a longitudinally extending cavity having a rectangular cross section with one major surface of said fifth panel positioned along one major surface of said first panel within said cavity, said fifth panel having a plurality of through cuts between said major surfaces each defining a hook portion of said fifth panel projecting toward a first end of said fifth panel, said hook portions each being adapted to be received in a through opening in a product enclosure having a therein to afford supporting a plurality of the product enclosures on said fifth panel, and said five panel folder having means along the opposite longitudinal sides of said fourth panel for affording manual separation of said fourth panel from between said third and fifth panels to separate said fifth panel from said fourth panel and to afford access to said fifth panel and product enclosures on said fifth panel within said cavity when said folder is folded to define said cavity.

8. A fiberboard folder according to claim 7 wherein said fifth panel has a through aperture adjacent said first end adapted, after said fifth panel is separated from said fourth panel, for receiving a hook to hang said fifth panel and thereby display cards having products secured thereto supported on said hook portions.

9. A fiberboard folder according to claim 7 wherein said means along the opposite longitudinal sides of said fourth panel for affording manual separation of said fourth panel from between said third and fifth panels comprises rows of perforations through said fiberboard folder along the sides of said fourth panel.

10. A fiberboard folder according to claim 7 wherein said fifth panel has openings around said hook portions and said hook portions each have generally the shape of a blunted arrowhead with opposite sides, barbs projecting from said opposite sides at the distal end of the hook portion that have a width slightly greater that the width of the openings in the product enclosures, and has a base at the proximal portion of said hook portion that is no greater in width than the opening in said product enclosures so that said barbs are deflected as they pass through the opening in the product enclosure, and restrict movement of the product enclosure back over the barbs.

11. A fiberboard folder according to claim 7 wherein said fifth panel has opening around said hook portions and said hook portions each have generally the shape of an inverted "J" with a side projection at its distal end portion that has a width greater that the width of the opening in the product enclosures when measured at a right angle to the longitudinal sides of said fifth panel, and has a distal base portion that is no greater in width than the opening in the product enclosure, the product enclosure being engaged with the distal end portion of the hook portion with the product enclosure disposed at about a right angle to the orientation desired, and rotated around said side projection into the desired orientation, said hook portion having an edge surface on said side projection then preventing the product enclosure from moving off of the hook portion in a direction at right angles to said edge surface.

12. A fiberboard folder according to claim 1 wherein said fifth panel has an opening on each side of proximal portion of each of said hook portions and said hook portions each have generally the shape of an inverted "U" and a distal end portion separated from the rest of the fifth panel by only said cut through said fifth panel, said hook portion having a width that is no greater than that of the opening in the product enclosure, said hook portion being inserted through the opening in the product enclosure with portions of the product enclosure between the opening and an adjacent edge of the product enclosure at the opposite sides of the opening in the product enclosure passing through the openings at the sides of the hook portion and being slightly bent so that the distal end portion of the hook portion is positioned closely adjacent the portion of the fifth panel from which it was cut, thereby securing the portions of the product enclosure in the openings and restricting movement of the product enclosure off of the hook portion.

13. A method for handling cards having products secured thereto and each having a through opening, said method comprising the steps of:

providing a five panel fiberboard folder including first, second, third, fourth and fifth elongate panels each having opposite longitudinally extending sides and opposite major surfaces extending between said sides, one longitudinally extending side of said fourth panel being joined to one longitudinally extending side of said third panel, and the longitudinally extending side of said fourth panel opposite said third panel being joined to one longitudinally extending side of said fifth panel, said fifth panel having a plurality of through cuts between said major surfaces each defining a hook portion of said fifth panel projecting toward a first end of said fifth panel, and said five panel folder having means along the opposite longitudinal sides of said fourth panel for affording separation of said fourth panel from between said third and fifth panels, engaging said product enclosures having products therein with said hook portions of said fifth panel so that said product enclosures are supported along one major surface of said fifth panel, and folding said folder between said sides so that said first, second, third, and fourth elongate side panels form a longitudinally extending cavity having a rectangular cross section, and the major surface of said fifth panel opposite said product enclosures is positioned along one major surface of said first panel within said cavity, moving said folded folder containing said product enclosures to a different location, separating said fourth panel from between said third and fifth panels, and removing said fifth panel and said product enclosures having products therein on said fifth panel from within said cavity.

14. A method according to claim 13 wherein said fifth panel has a through aperture adjacent said first end, and said method further comprises the step after said removing step of hanging said fifth panel from a projection received in said through aperture to display said products in said product enclosures.

* * * * *

UNITED STATES PATENT AND TRADEMARK OFFICE

CERTIFICATE OF CORRECTION

PATENT NO. : 5,868,254
DATED : February 9, 1999
INVENTOR(S) : Price et al.

It is certified that error appears in the above-identified patent and that said Letters Patent is hereby corrected as shown below:

Column 4,
Line 43, "can separated" should read, -- can be separated --.
Line 45, "form" should read -- from --.

Column 5,
Line 62, second occurrence of "that" should read -- than --.

Column 6,
Line 5, second occurrence of "that" s should read -- than --.
Line 14, "porion" should read -- portion --.

Column 7,
Line 41, "that" should read -- than --.

Column 8,
Line 22, "having a therein" should read -- having a product therein --.
Line 48, "that" should read -- than --.
Line 59, "that" should read -- than --.

Signed and Sealed this

Twenty-sixth Day of February, 2002

*Attest:*

*Attesting Officer*

JAMES E. ROGAN
*Director of the United States Patent and Trademark Office*